US007766694B2

(12) United States Patent
Tanaka et al.

(10) Patent No.: US 7,766,694 B2
(45) Date of Patent: Aug. 3, 2010

(54) ELECTRICAL CONNECTOR

(75) Inventors: Kouichirou Tanaka, Fukuoka (JP); Jin Tateishi, Fukuoka (JP)

(73) Assignee: I-Pex Co., Ltd. (JP)

( * ) Notice: Subject to any disclaimer, the term of this patent is extended or adjusted under 35 U.S.C. 154(b) by 0 days.

(21) Appl. No.: 12/366,803

(22) Filed: Feb. 6, 2009

(65) Prior Publication Data

US 2009/0317987 A1 Dec. 24, 2009

(30) Foreign Application Priority Data

Jun. 18, 2008 (JP) ..... 2008-159554

(51) Int. Cl.
*H01R 12/24* (2006.01)

(52) U.S. Cl. ..... 439/495; 439/260

(58) Field of Classification Search ..... 439/495, 439/494, 492, 260, 493
See application file for complete search history.

(56) References Cited

U.S. PATENT DOCUMENTS

| | | | | |
|---|---|---|---|---|
| 6,726,497 | B2 * | 4/2004 | Nogawa et al. | 439/260 |
| 7,044,773 | B2 * | 5/2006 | Suzuki et al. | 439/495 |
| 7,083,454 | B2 * | 8/2006 | Suzuki | 439/260 |
| 7,094,093 | B2 * | 8/2006 | Nakano et al. | 439/495 |
| 7,258,561 | B2 * | 8/2007 | Fukazawa | 439/260 |
| 7,261,588 | B2 * | 8/2007 | Yokoyama | 439/495 |
| 7,452,227 | B2 * | 11/2008 | Matoba et al. | 439/260 |
| 7,540,764 | B2 * | 6/2009 | Suzuki et al. | 439/495 |

FOREIGN PATENT DOCUMENTS

| | | |
|---|---|---|
| JP | 10-208810 | 8/1998 |
| JP | 2002-270290 A | 9/2002 |
| JP | 2004-071160 | 3/2004 |
| JP | 2007-122966 A | 5/2007 |
| JP | 2007-173043 A | 7/2007 |

* cited by examiner

*Primary Examiner*—Xuong M Chung-Trans
(74) *Attorney, Agent, or Firm*—Studebaker & Brackett PC; Donald R. Studebaker

(57) ABSTRACT

An electrical connector including a housing, conductive contacts arranged in the housing, each of which has a fixed beam fixed to the housing, a movable beam having a contacting projection and an engaging portion and a connecting strut for connecting the movable beam with the fixed beam, and an actuator rotatable for taking up first and second stations selectively and for engaging with the engaging portion of the conductive contact to cause the contacting projection of the conductive contact to come into press-contact with one of connecting terminals arranged on a circuit board having been inserted into the housing when rotated to shift from the first station to the second station, wherein a first side edge portion of the connecting strut on the side of the contacting projection of the movable beam is substantially perpendicular to the fixed beam and a second side edge portion of the connecting strut on the side of the engaging portion of the movable beam slants from the movable beam to the fixed beam so that a first end portion of the connecting strut connected with the fixed beam is wider in a direction along which the fixed beam elongates than a second end portion of the connecting strut connected with the movable beam, and the movable beam swings with a fulcrum at the second end portion of the connecting strut.

4 Claims, 3 Drawing Sheets

ELECTRICAL CONNECTOR

BACKGROUND OF THE INVENTION

1. Field of the Invention

The present invention relates generally to an electrical connector, and more particularly to an improvement in an electrical connector having a plurality of conductive contacts provided for coming into press-contact with connecting terminals provided on a circuit board, such as a flexible printed circuit board (FPC), so as to put the circuit board in electrical connection with another electrical device, such as a main solid circuit board.

2. Description of the Prior Art

A circuit board, such as a relatively small-sized flexible printed circuit board or the like, used in electronic apparatus of various kinds is often mounted on a main solid circuit board, on which various electrical parts are directly mounted, by means of an electrical connector which is fixed to and connected electrically with the main solid circuit board. The electrical connector has a plurality of conductive contacts for coming into contact with connecting terminals provided on the circuit board and is operative to connect electrically, through the conductive contacts, the connecting terminals provided on the circuit board with conductive circuit pattern portions formed on the main solid circuit board.

For example, a previously proposed electrical connector, which is used for mounting a flexible printed circuit board on a main solid circuit board, is provided with a housing made of insulator which has an opening through which at least a part of the flexible printed circuit board is inserted into the housing. In the housing, a plurality of conductive contacts are provided to be arranged along the opening. These conductive contacts are operative to come into contact respectively with a plurality of connecting terminals provided on the flexible printed circuit board when the flexible printed circuit board is inserted into the housing through the opening. The electrical connector is further provided with an actuator which is provided to be rotatable to the housing so as to engage with each of the conductive contacts arranged in the housing. When the actuator is rotated in regard to the housing, an operating portion of each of the conductive contacts is moved by the actuator to put the conductive contact in press-contact with a corresponding one of the connecting terminals provided on the flexible printed circuit board.

Each of the conductive contacts arranged in the housing is made of conductive resilient material to have a fixed part fixed to the housing and a movable part coupled with the fixed part for constituting the operating portion. The fixed part of the conductive contact is connected electrically with a conductive circuit pattern portion provided on the main solid circuit board. The movable part of the conductive contact is provided thereon with a contacting projection for coming into press-contact with the connecting terminal provided on the flexible printed circuit board and moved by the actuator.

In the previously proposed electrical connector as mentioned above, when the flexible printed circuit board is inserted into the housing through the opening provided thereon and the actuator is rotated in a predetermined direction, the actuator operates to move the movable part of each of the conductive contacts for causing the contacting projection provided thereon to come into press-contact with a corresponding one of the connecting terminals provided on the flexible printed circuit board, and then, when contacting projection provided the movable part of each of the conductive contacts is put in a condition of press-contact with the connecting terminal provided on the flexible printed circuit board and the actuator is rotated in a direction opposite to the above-mentioned predetermined direction, the actuator operates to move the movable part of each of the conductive contacts for releasing the contacting projection provided thereon from the condition of press-contact with the connecting terminal provided on the flexible printed circuit board, as shown in, for example, the Japanese patent application published before examination under publication number 2002-270290 (Published patent document 1).

In such an electrical connector as shown in the published patent document 1 constituting a first previous electrical connector, each of the conductive contacts is formed into an H-shaped member. The H-shaped member has a pair of beams coupled with each other through a connecting part. One of the beams constitutes the fixed part of the conductive contact and the other of the beams constitutes the movable part of the conductive contact. When the flexible printed circuit board is inserted into the housing through the opening provided thereon, a part of the flexible printed circuit board, on which the connecting terminals are provided, is put between the fixed and movable parts of each of the conductive contacts.

Then, when the actuator is rotated for moving the movable part of each of the conductive contacts to cause the contacting projection provided thereon to come into press-contact with the corresponding connecting terminal on the flexible printed circuit board, the part of the flexible printed circuit board, on which the connecting terminals are arranged, is held between the fixed part of each of the conductive contacts and the contacting projection provided on the movable part of each of the conductive contacts, which is brought into press-contact with the corresponding connecting terminal.

There has been another type of previously proposed electrical connector constituting a second previous electrical connector which is constructed basically in a similar manner to the first previous electrical connector mentioned above. In the second previous electrical connector which is provided with a plurality of conductive contacts arranged in a housing, each of which has a fixed part, a movable part and a connecting part for connecting the movable part with the fixed part, and an actuator provided to be rotatable to the housing, when a circuit board, such as a flexible printed circuit board, is inserted into the housing through an opening provided on the same and the actuator is rotated to move the movable part of each of the conductive contacts for causing a contacting projection provided on the movable part of the conductive contact to come into press-contact with a corresponding one of connecting terminals provided on the circuit board, the connecting part of each of the conductive contacts inclines toward the contacting projection provided on the movable part of the conductive contact, as shown in, for example, the Japanese patent application published before examination under publication number 2004-71160 (Published patent document 2). With the second previous electrical connector thus constituted, the movable part of each of the conductive contacts is able to be easily moved by means of rotating movement of the actuator to cause the contacting projection provided thereon to come into press-contact with the connecting terminal provided on the circuit board.

Besides, there has been a further different type of previously proposed electrical connector constituting a third previous electrical connector which is also constructed basically in a similar manner to the first previous electrical connector mentioned above. In the third previous electrical connector which is provided with a plurality of conductive contacts arranged in a housing, each of which has a fixed part, a movable part and a connecting part for connecting the movable part with the fixed part, and an actuator provided to be rotatable to the housing, an upper end portion of the connecting part of each of the conductive contacts inclines toward a contacting projection provided on the movable part of the conductive contact when a circuit board, such as a flexible printed circuit board, is inserted into the housing through an opening provided on the same and the actuator is rotated to move the movable part of each of the conductive contacts for causing the contacting projection provided on the movable part of the conductive contact to come into press-contact with a corresponding one of connecting terminals provided on the circuit board, and a lower end portion of the connecting part of each of the conductive contacts stands out toward the opening provided on the housing so as to be wider than the upper end portion of the connecting part of the conductive contact, as shown in, for example, the Japanese patent application published before examination under publication number 2007-173043 (Published patent document 3). With the third previous electrical connector thus constituted, a fulcrum for inclining movement of the upper end portion of the connecting part of each of the conductive contacts is able to be easily formed in the connecting part of the conductive contact when the upper end portion of the connecting part of each of the conductive contact inclines in synchronism with rotating movement of the actuator.

In each of the electrical connectors thus proposed previously to be used for mounting the circuit board, such as the flexible printed circuit board, on the main solid circuit board, when the circuit board is inserted into the housing through the opening provided thereon so as to be brought in the condition in which the conductive contacts arranged in the housing are operative to come into press-contact respectively with the connecting terminals provided on the circuit board, the part of the circuit board on which the connecting terminals are arranged is put between the fixed and movable parts of each of the conductive contacts in the housing. At this time, a top end of the part of the circuit board put between the fixed and movable parts of each of the conductive contacts comes into contact with the connecting part or other parts of each of the conductive contacts in the housing so as to be prevented from going on further deep in the housing. Therefore, the circuit board is not inserted deep enough into the housing so that it is undesirably feared that the part of the circuit board put between the fixed and movable parts of each of the conductive contacts is unstably held in the housing.

Especially, in the case of the second previous electrical connector in which the connecting part of each of the conductive contacts provided for connecting the movable part of the conductive contact with the fixed part of the conductive contact inclines toward the contacting projection provided on the movable part of the conductive contact when the circuit board is inserted into the housing through the opening provided thereon so that the part of the circuit board, on which the connecting terminals are arranged, is put between the fixed and movable parts of each of the conductive contacts in the housing and the actuator is rotated to move the movable part of each of the conductive contacts for causing the contacting projection provided on the movable part of the conductive contact to come into press-contact with a corresponding one of connecting terminals provided on the portion of the circuit board in the housing, the top end of the part of the circuit board in the housing, which is put in contact with the connecting part of each of the conductive contacts, is moved toward the opening provided on the housing by the connecting part of each of the conductive contacts inclining toward the contacting projection provided on the movable part of the conductive contact. As a result, the part of the circuit board having been inserted into the housing through the opening provided thereon to be put between the fixed and movable parts of each of the conductive contacts in the housing is moved to shift from the inside toward the outside of the housing and therefore held unstably in the housing.

Further, in the case of the third previous electrical connector in which the lower end portion of the connecting part of each of the conductive contacts provided for connecting the movable part of the conductive contact with the fixed part of the conductive contact stands out toward the opening provided on the housing so as to be wider than the upper end portion of the connecting part of the conductive contact, when the circuit board is inserted into the housing through the opening provided thereon so that the part of the circuit board, on which the connecting terminals are arranged, is put between the fixed and movable parts of each of the conductive contacts in the housing, the top end of the part of the circuit board comes into contact with the lower end portion of the connecting part of each of the conductive contacts, which stands out toward the opening provided on the housing, at a relatively shallow position in the housing so as to be prevented from going on further deep in the housing As a result, the part of the circuit board can not be inserted deep enough in the housing and therefore held unstably in the housing.

OBJECTS AND SUMMARY OF THE INVENTION

Accordingly, it is an object of the present invention to provide an electrical connector used, for example, for mounting a circuit board, such as a flexible printed circuit board, on a main solid circuit board, which comprises a housing made of insulator and provided with an opening through which a circuit board is inserted into the housing, a plurality of conductive contacts provided to be arranged in the housing, and an actuator provided to be rotatable to the housing for engaging with the conductive contacts and operative to cause the conductive contacts to come into press-contact with connecting terminals provided on the circuit board having been inserted into the housing when rotated in regard to the housing, and which avoids the aforementioned disadvantages encountered with the prior art Another object of the present invention is to provide an electrical connector used, for example, for mounting a circuit board, such as a flexible printed circuit board, on a main solid circuit board, which comprises a housing made of insulator and provided with an opening through which a circuit board is inserted into the housing, a plurality of conductive contacts provided to be arranged in the housing, and an actuator provided to be rotatable to the housing for engaging with the conductive contacts and operative to cause the conductive contacts to come into press-contact with connecting terminals provided on the circuit board having been inserted into the housing when rotated in regard to the housing, and in which when the circuit board is inserted into the housing through the opening provided thereon so that a part of the circuit board, on which the connecting terminals are arranged, is put in the housing, the part of the circuit board can be inserted deep enough in the housing and therefore held stably in the housing.

A further object of the present invention is to provide an electrical connector used, for example, for mounting a circuit board, such as a flexible printed circuit board, on a main solid circuit board, which comprises a housing made of insulator and provided with an opening through which a circuit board is inserted into the housing, a plurality of conductive contacts provided to be arranged in the housing, and an actuator provided to be rotatable to the housing for engaging with the conductive contacts and operative to cause the conductive contacts to come into press-contact with connecting terminals provided on the circuit board having been inserted into the housing when rotated in regard to the housing, and in which a part of each of the conductive contacts can be easily moved to come into press-contact with one of the connecting terminals provided on the circuit board having been inserted into the housing with rotating movement of the actuator.

According to the present invention, as claimed in any one of claims, there is provided an electrical connector, which comprises a housing made of insulator and provided with an opening through which a circuit board is inserted into the housing, a plurality of conductive contacts provided to be arranged in the housing to be positioned to correspond respectively to connecting terminals provided on the circuit board when the circuit board is inserted into the housing through the opening provided thereon, and an actuator provided to be rotatable to the housing for taking up a first station and a second station selectively and for engage with the conductive contacts to causing each of the conductive contacts to come into press-contact with one of the connecting terminals corresponding thereto when the circuit board is inserted into the housing through the opening provided thereon and the actuator is shifted from the first station to the second station and to cause each of the conductive contacts to get out of press-contact with the corresponding one of the connecting terminals when the circuit board has been inserted into the housing and the actuator is shifted from the second station to the first station, wherein each of the conductive contacts has a fixed beam fixed to the housing, a movable beam provided thereon with a contacting projection for coming into contact with the corresponding one of the connecting terminals and an engaging portion for engaging with the actuator, and a connecting strut for connecting a portion of the movable beam between the contacting projection and the engaging portion with the fixed beam to support the movable beam, wherein a first side edge portion of the connecting strut on the side of the contacting projection of the movable beam is substantially perpendicular to the fixed beam and a second side edge portion of the connecting strut on the side of the engaging portion of the movable beam slants from the movable beam to the fixed beam so that a first end portion of the connecting strut connected with the fixed beam is wider in a direction along which the fixed beam elongates than a second end portion of the connecting strut connected with the movable beam, and wherein the movable beam swings with a fulcrum at the second end portion of the connecting strut connected with the movable beam.

In the electrical connector thus constituted in accordance with the present invention, each of the conductive contacts having the fixed beam, the movable beam and the connecting strut is formed entirely into an H-shaped plate member and a part of the circuit board, on which the connecting terminals are arranged, is put between the fixed and movable beams of each of the conductive contacts when the circuit board is inserted into the housing through the opening provided thereon. When the actuator is rotated to shift from the first station to the second station after the circuit board has been inserted into the housing through the opening provided thereon, the actuator in the rotating movement from the first station toward the second station operates to put pressure upon the engaging portion of the movable beam of each of the conductive contacts, for example, by causing a cam provided on the actuator to push the engaging portion of the movable beam, for causing the movable beam to swing with the fulcrum at the second end portion of the connecting strut connected with the movable beam so that the contacting projection of the movable beam comes into press-contact with one of the connecting terminals arranged on the part of the circuit board having been inserted into the housing. As a result, each of the conductive contacts is put in a condition of press-contact with the corresponding one of the connecting terminals provided on the circuit board having been inserted into the housing.

After that, when the actuator is rotated to shift from the second station to the first station, the actuator in the rotating movement from the second station toward the first station operates to remove the pressure from the engaging portion of the movable beam of each of the conductive contacts, for example, by causing the cam engaging with the actuator to go away from the engaging portion of the movable beam, for cause again the movable beam of each of the conductive contacts to swing with the fulcrum at the second end portion of the connecting strut connected with the movable beam so that the contacting projection of the movable beam get out of press-contact with the corresponding one of the connecting terminals. As a result, each of the conductive contacts is released from the condition of press-contact with the corresponding one of the connecting terminals provided on the circuit board having been inserted into the housing.

The electrical connector in accordance with the present invention explained above is fixed to, for example, a main solid circuit board in an electronic apparatus and each of the conductive contacts arranged in the housing of the electrical connector is connected electrically with a conductive circuit pattern portion provided on the main solid circuit board. Then, when the circuit board is inserted into the housing through the opening provided thereon and the actuator is rotated to shift from the first station to the second station so that each of the conductive contacts is put in the condition of press-contact with the corresponding one of the connecting terminals provided on the circuit board having been inserted into the housing, as described above, the circuit board is electrically mounted through the electrical connector on the main solid circuit board.

With the electrical connector thus constituted in accordance with the present invention, in which each of the conductive contacts has the fixed beam, the movable beam provided thereon with the contacting projection and the engaging portion and the connecting strut for connecting the movable beam with the fixed beam, the first side edge portion of the connecting strut on the side of the contacting projection of the movable beam is substantially perpendicular to the fixed beam and the second side edge portion of the connecting strut on the side of the engaging portion of the movable beams slants from the movable beam to the fixed beam. Accordingly, the connecting strut of each of the conductive contacts can be so formed as to have stiffness sufficient for supporting stably the movable beam of the conductive contact and the first side edge portion of the connecting strut of each of the conductive contacts can be so formed as to allow a top end of the part of the circuit board, which is provided thereon with the connecting terminals and put in the housing, to go on deep in the housing so that the part of the circuit board can be inserted deep enough in the housing and therefore held stably in the housing.

Further, with each of the conductive contacts in the electrical connector according to the present invention, since the first end portion of the connecting strut connected with the fixed beam is wider in the direction along which the fixed beam elongated than the second end portion of the connecting strut connected with the movable beam and the movable beam swings with the fulcrum at the second end portion of the connecting strut connected with the movable beam. Accordingly, the movable beam of each of the conductive contacts can be easily moved to swing with the fulcrum at the second end portion of the connecting strut for causing the contacting projection provided thereon to come into press-contact with the corresponding one of the connecting terminals provided on the circuit board having been inserted into the housing with the rotating movement of the actuator, and the connecting strut of each of the conductive contacts can be prevented from inclining toward the contacting projection of the movable beams of the conductive contact so that the part of the circuit board, which is provided thereon with the connecting terminals and put in the housing, can be prevented from being moved by the connecting strut to shift from the inside toward the outside of the housing and therefore being held unstably in the housing.

In addition, with the electrical connector according to the present invention, when the movable beam of each of the conductive contacts swings with the fulcrum at the second end portion of the connecting strut of the conductive contact to cause the contacting projection provided thereon to come into press-contact with the corresponding one of the connecting terminals arranged on the part of the circuit board having been inserted into the housing, the contacting objection of the movable beam of each of the conductive contacts operates to exert upon the part of the circuit board a component of pressure in a direction toward the connecting strut of the conductive contact and accordingly the part of the circuit board can be held stably in the housing.

The above, and other objects, features and advantages of the present invention will become apparent from the following detailed description taken in conjunction with the accompanying drawings.

DESCRIPTION OF THE PREFERRED EMBODIMENTS

Figure 1:
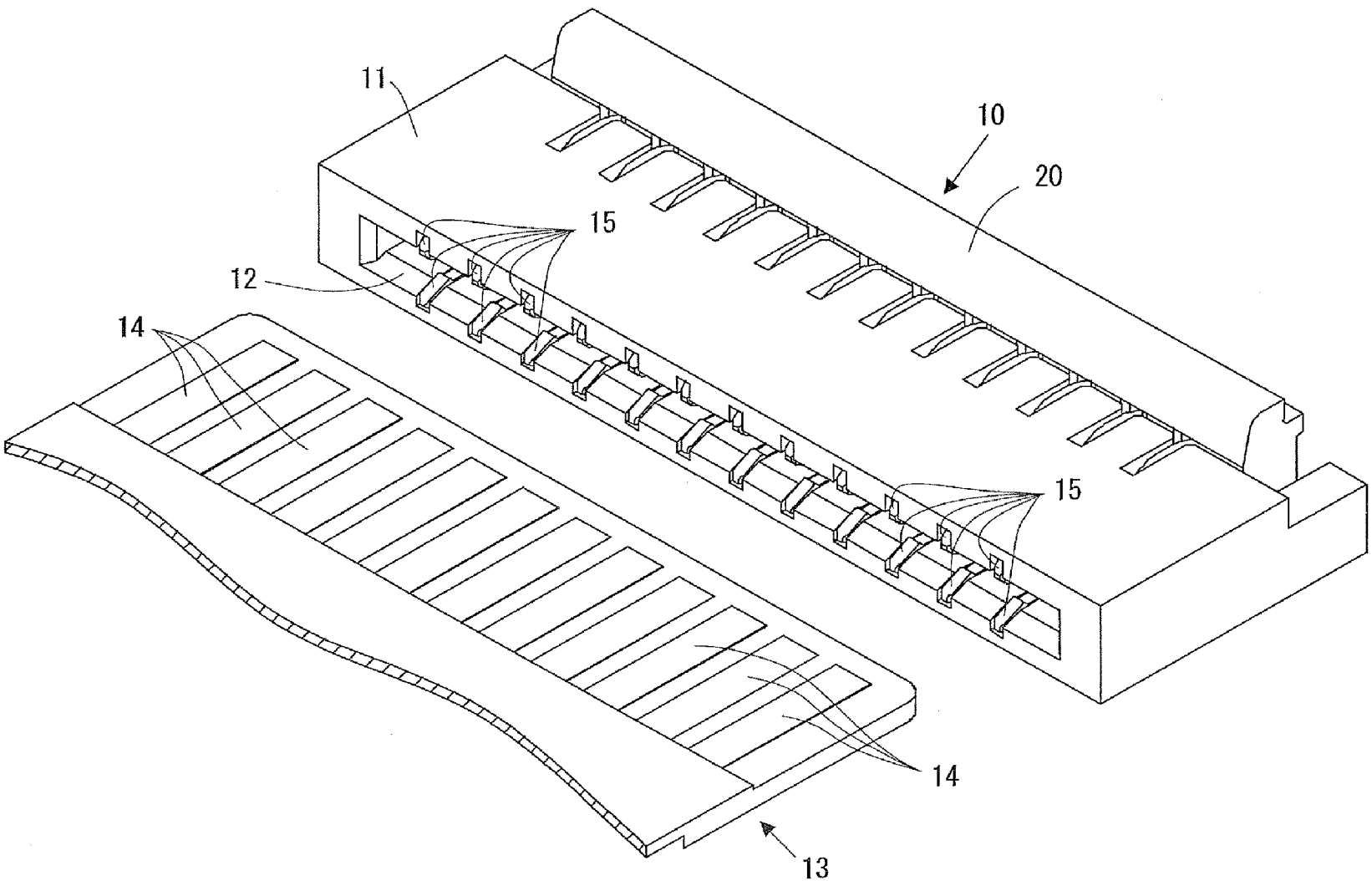
FIG. 1 is a schematic perspective view showing an embodiment of electrical connector according to the present invention, together with a part of a flexible printed circuit board which is to be inserted into the embodiment.

FIG. 1 shows an embodiment of electrical connector according to the present invention, together with a part of a flexible printed circuit board which is to be inserted into the embodiment.

Referring to FIG. 1, an electrical connector 10, which constitutes the embodiment of electrical connector according to the present invention, has a housing 11 made of insulator such as plastics or the like. When the electrical connector 10 is put in practical use, the electrical connector 10 including the housing 11 is fixed as a whole to a main solid circuit board in an electronic apparatus (not shown in the drawings).

The housing 11 is provided with an opening 12 through which a circuit board is inserted into the housing 11. For example, a part of a flexible printed circuit board 13 as the circuit board is inserted into the housing 11 through the opening 12 provided thereon. On the part of the flexible printed circuit board 13, which is inserted into the housing 11 through the opening 12, a plurality of connecting terminals 14 each made of conductive material and formed into a rectangular plate member are provided to be arranged. Each of the connecting terminals 14 is electrically connected with a conducting circuit pattern portion provided on the flexible printed circuit board 13, an illustration of which is omitted.

A plurality of conductive contacts 15 are provided in the housing 11 of the electrical connector 10 to be arranged in a longitudinal direction of the housing 11. Each of the conductive contacts 15 elongates in a direction along which the part of the flexible printed circuit board 13 is inserted into the housing 11 and drawn out of the housing 11 and is positioned to correspond to one of the connecting terminals 14 arranged on the part of the flexible printed circuit board 13 when the part of the flexible printed circuit board 13 is inserted into the housing 11 through the opening 12.

Figure 2:
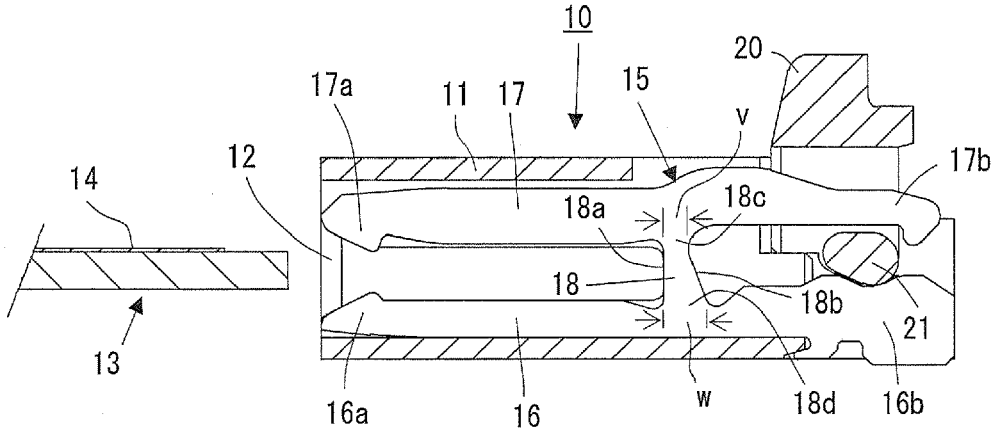
FIG. 2 is a schematic cross sectional view showing the embodiment shown in FIG. 1, together with the part of the flexible printed circuit board shown in FIG. 1.

Each of the conductive contacts 15 is made of conductive resilient material and formed entirely into an H-shaped plate member, as shown in FIG. 2 showing cross sections of the electrical connector 10 and the part of the flexible printed circuit board 13 taken along a direction substantially perpendicular to a direction along which the conductive contacts 15 are arranged.

Referring to FIG. 2, the conductive contact 15 has a fixed beam 16 fixed to the housing 11, a movable beam 17 which is able to shift its position in the housing 11 for serving as an operating part of the conductive contact 15 and a connecting strut 18 for connecting the movable beam 17 with the fixed beam 16 to support the movable beam 17.

The fixed beam 16 of the conductive contact 15 has one end portion **16*a* which is disposed at the opening 12 provided on the housing 11 and the other end portion 16*b* which engages with the housing 11 and constitutes a connecting terminal portion. The connecting terminal portion of the fixed beam 16 is electrically connected with, for example, a conducting circuit pattern portion provided on the main solid circuit board to which the electrical connector 10** is fixed. An illustration of the conducting circuit pattern portion on the main circuit board is omitted.

The movable beam 17 of the conductive contact 15 has one end portion **17*a* which is provided thereon with a contacting projection for coming into press-contact with the connecting terminal 14 arranged on the part of the flexible printed circuit board 13 when the part of the flexible printed circuit board 13 is inserted into the housing 11 through the opening 12 and the other end portion 17*b* which is provided with an engaging portion for engaging with an actuator 20 having a cam 21, which will be explained later, so as to receive a pressure from the cam 21 of the actuator 20. The contacting projection provided on the end portion 17*a* of the movable beam 17 is disposed at the opening 12 provided on the housing 11 to be opposite to the end portion 16*a* of the fixed beam 16. The end portion 17*b* of the movable beam 17 is positioned to be opposite to the end portion 16*b* of the fixed beam 16**.

The connecting strut 18 of the conductive contact 15 connects a portion of the movable beam 17 between the contacting projection provided on the end portion **17*a* and the engaging portion provided on the end portion 17*b* with a portion of the fixed beam 16 between the end portion 16*a* and the end portion 16*b* to support the movable beam 17 in the housing 11. One side edge portion 18*a* of the connecting strut 18 on the side of the contacting projection provided on the end portion 17*a* of the movable beam 17 (on the side of the end portion 16*a* of the fixed beam 16) is substantially perpendicular to the fixed beam 16 and the other side edge portion 18*b* of the connecting strut 18 on the side of the engaging portion provided on the end portion 17***b* of the movable beam 17 (on the side of the end portion 16*b* of the fixed beam 16) slants from the movable beam 17 to the fixed beam 16 so that an end portion 18*d* of the connecting strut 18 connected with the fixed beam 16 is wider in a direction along which the fixed beam 16 elongates than an end portion 18*c* of the connecting strut 18 connected with the movable beam 17, that is, the width w of the end portion 18*d* of the connecting strut 18 is larger than the width v of the end portion 18*c* of the connecting strut 18.

As described above, in each of the conductive contacts 15, the connecting strut 18 which has the side edge portion 18*a* on the side of the contacting projection provided on the end portion 17*a* of the movable beam 17 substantially perpendicular to the fixed beam 16 and the side edge portion 18*b* on the side of the engaging portion provided on the end portion 17*b* of the movable beam 17 slanting from the movable beam 17 to the fixed beam 16 so that the width w of the end portion 18*d* of the connecting strut 18 is larger than the width v of the end portion 18*c* of the connecting strut 18, supports the movable beam 17. Accordingly, the connecting strut 18 is so formed as to have stiffness sufficient for supporting stably the movable beam 17 and the movable beam 17 swings stably with a fulcrum at the end portion 18*c* of the connecting strut 18 when the engaging portion provided on the end portion 17*b* of the movable beam 17 receives the pressure from the cam 21 of the actuator 20, which will be explained later, or the pressure from the cam 21 of the actuator 20 is removed from the engaging portion provided on the end portion 17*b* of the movable beam 17.

Further, the electrical connector 10 has the actuator 20 which is provided to be rotatable to the housing 11. The actuator 20 is shaped into a long and narrow member elongating along the arrangement of the conductive contacts 15 so that a longitudinal direction of the actuator 20 is the same as the longitudinal direction of the housing 11.

Figure 4:
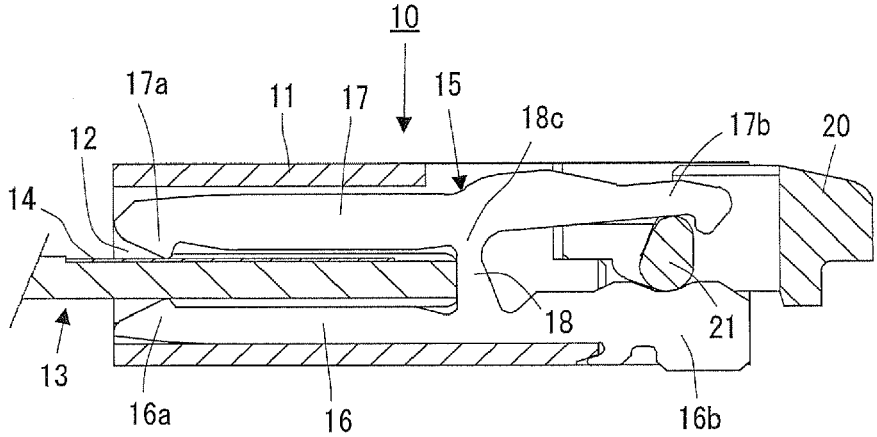

The actuator 20 is postured to take up first and second stations selectively. In the first station, the actuator 20 keeps rising from the housing 11, as shown in FIGS. 1 and 2, and in the second station, the actuator 20 keeps lying down on the housing 11, as shown in FIG. 4 described later. Then, the actuator 20 is rotated to shift from the first station to the second station or from the second station to the first station.

The actuator 20 has a plurality of cam 21, one of which is shown in FIG. 2, each provided for engaging with the engaging portion provided on the end portion 17*b* of the movable beam 17 of one of the conductive contacts 15 corresponding thereto. Each of the cams 21 has an oval cross section, as shown in FIG. 2. The oval cross section of the cam 21 has the maximum dimension measured across in a direction which varies with the rotating movement of the actuator 20. Hereinafter, this direction is referred to as a maximum dimension direction. The cam 21 is put between the end portion 16*b* of the fixed beam 16 and the end portion 17*b* of the movable beam 17 of the corresponding one of the conductive contacts 15 and caused to engage with both of the end portion 16*b* of the fixed beam 16 and the engaging portion provided on the end portion 17*b* of the movable beam 17 with the rotating movement of the actuator 20.

As described above, the cams 21 of the actuator 20 are provided for corresponding to the conductive contacts 15, respectively, and since the conductive contacts 15 are arranged along the longitudinal direction of the housing 11, the cams 21 are also arranged on the actuator 20 along the longitudinal direction of the housing 11.

Figure 3:
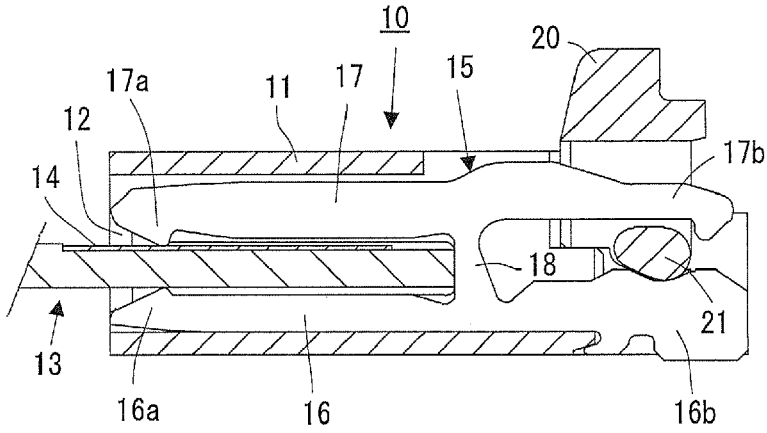
FIGS. 3 and 4 are schematic cross sectional views used for explaining the structure and operation of the embodiment shown in FIGS. 1 and 2.

Under such a situation, when the actuator 20 is postured to take the first station, the part of the flexible printed circuit board 13 is inserted into the housing 11 through the opening 12 provided thereon to be put between the fixed beam 16 and the movable beam 17 of each of the conductive contacts 15 in the housing 11, as shown in FIG. 3. Then, when the actuator 20 is rotated to shift from the first station to the second station, each of the conductive contacts 15 is operative to cause the contacting projection provided on the end portion 17*a* of the movable beam 17 to come into press-contact with the corresponding one of the connecting terminals 14 arranged on the part of the flexible printed circuit board 13 having been inserted into the housing 11.

On that occasion, since the side edge portion 18*a* of the connecting strut 18 on the side of the contacting projection provided on the end portion 17*a* of the movable beam 17 is substantially perpendicular to the fixed beam 16, a top end of the part of the flexible printed circuit board 13 is not prevented from going on deep in the housing 11 by the connecting strut 18 but able to be so positioned deep in the housing 11 as to come into contact with the side edge portion 18*a* of the connecting strut 18, as shown in FIG. 3, when the part of the flexible printed circuit board 13 is inserted into the housing 11 through the opening 12 provided thereon. That is, the connecting strut 18 having the side edge portion 18*a* substantially perpendicular to the fixed beam 16 allows the top end of the part of the flexible printed circuit board 13 to be positioned deep enough in the housing 11 and thereby the part of the flexible printed circuit board 13 put between the fixed beam 16 and the movable beam 17 of each of the conductive contacts 15 in the housing 11 can be disposed at a position to be held stably.

Then, when the actuator 20 is rotated to shift from the first station to the second station, each of the cams 21 provided on the actuator 20 is also rotated to vary the maximum dimension direction with the rotating movement of the actuator 20.

As shown in FIG. 4, each of the cams 21 is operative to engage with both of the end portion 16*b* of the fixed beam 16 and the engaging portion provided on the end portion 17*b* of the movable beam 17 of the corresponding one of the conductive contacts 15 with its rotating movement varying the maximum dimension direction and to exert the pressure upon the engaging portion provided on the end portion 17*b* of the movable beam 17 so as to move the end portion 17*b* of the movable beam 17 to go way from the end portion 16*b* of the fixed beam 16. Thereby, the movable beam 17 of the conductive contact 15 is moved by the cam 21 to swing with the fulcrum at the end portion 18*c* of the connecting strut 18 of the conductive contact 15 so as to cause the contacting projection provided on the end portion 17*a* to move toward the end portion 16*a* of the fixed beam 16 of the conductive contact 15 and come into press-contact with the corresponding one of the connecting terminals 14 arranged on the part of the flexible printed circuit board 13 having been inserted into the housing 11.

That is, when the actuator 20 is rotated to shift from the first station to the second station, the actuator 20 is operative to exert the pressure upon the engaging portion provided on the end portion 17*b* of the movable beam 17 of each of the conductive contacts 15 so that the movable beam 17 of the conductive contact 15 is moved to swing with the fulcrum at the end portion 18*c* of the connecting strut 18 of the conductive contact 15. The movable beam 17 moved to swing with the fulcrum at the end portion 18*c* of the connecting strut 18 operates to cause the contacting projection provided on the end portion 17*a* to come into press-contact with the corresponding one of the connecting terminals 14 arranged on the part of the flexible printed circuit board 13 having been inserted into the housing 11. Thereby, each of the conductive contacts 15 is brought in press-contact with the corresponding one of the connecting terminals 14 arranged on the part of the flexible printed circuit board 13 having been inserted into the housing 11. As a result, the flexible printed circuit board 13 is electrically mounted through the electrical connector 10 on the main solid circuit board to which the electrical connector 10 is fixed.

With the electrical connector 10 described above, in each of the conductive contacts 15, the movable beam 17 swings with the fulcrum at the end portion 18*c* of the connecting strut 18 which is formed to have the side edge portion 18*a* on the side of the contacting projection provided on the end portion 17*a* of the movable beam 17 substantially perpendicular to the fixed beam 16 and the side edge portion 18*b* on the side of the engaging portion provided on the end portion 17*b* of the movable beam 17 slanting from the movable beam 17 to the fixed beam 16 so that the width w of the end portion 18*d* of the connecting strut 18 is larger than the width v of the end portion 18*c* of the connecting strut 18, supports the movable beam 17 and therefore, to have stiffness sufficient for supporting stably the movable beam 17. Accordingly, the swinging movement of the movable beam 17 of each of the conductive contacts 15 can be conducted stably and the movable beam 17 of each of the conductive contacts 15 can be easily moved to cause the contacting projection provided on the end portion 17*a* to come into press-contact with the corresponding one of the connecting terminals 14 arranged on the part of the flexible printed circuit board 13 having been inserted into the housing 11 with the rotating movement of the actuator 20.

Further, when the movable beam 17 of each of the conductive contacts 15 swings with the fulcrum at the end portion 18*c* of the connecting strut 18 of the conductive contact 15, the connecting strut 18 can be prevented from inclining toward the contacting projection provided on the end portion 17*a* of the movable beam 17 so that the part of the flexible printed circuit board 13, which is provided thereon with the connecting terminals 14 and put in the housing 11, can be prevented from being moved by the connecting strut 18 to shift from the inside toward the outside of the housing 11 and therefore being held unstably in the housing 11.

In addition, when the movable beam 17 of each of the conductive contacts 15 swings with the fulcrum at the end portion 18*c* of the connecting strut 18 of the conductive contact 15 to cause the contacting projection provided on the end portion 17*a* to come into press-contact with the corresponding one of the connecting terminals 14 arranged on the part of the flexible printed circuit board 13 having been inserted into the housing 11, the contacting objection provided on the end portion 17*a* of the movable beam 17 operates to exert upon the part of the flexible printed circuit board 13 a component of pressure in a direction toward the connecting strut 18 and accordingly the part of the flexible printed circuit board 13 can be held stably in the housing 11.

Figure 5:
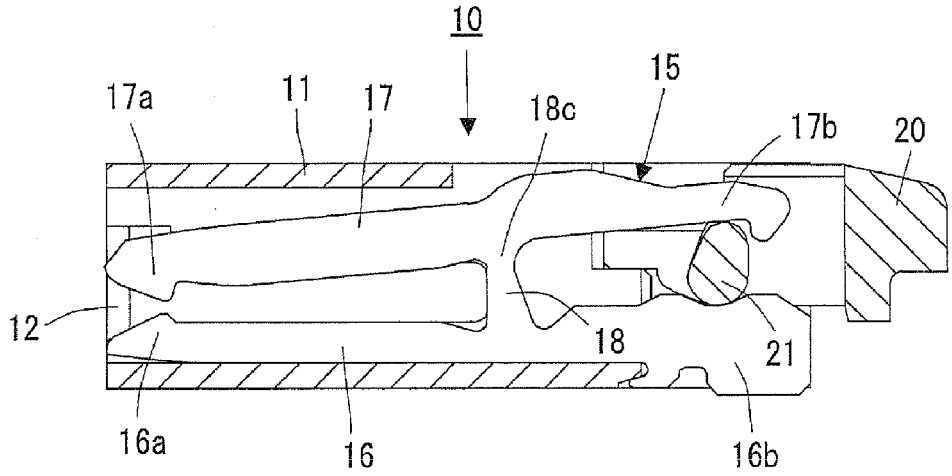
FIG. 5 is a schematic cross sectional view used for explaining a conductive contact provided in the embodiment shown in FIGS. 1 and 2.

Incidentally, with the electrical connector 10, even in the case wherein the part of the flexible printed circuit board 13 is not inserted into the housing 11 and the actuator 20 is rotated to shift from the first station to the second station so that each of the cams 21 operates to move the movable beam 17 of each of the conductive contacts 15 to swing with the fulcrum at the end portion 18*c* of the connecting strut 18 of the conductive contact 15 so as to cause the contacting projection provided on the end portion 17*a* to move toward the end portion 16*a* of the fixed beam 16 of the conductive contact 15, as shown in FIG. 5, the connecting strut 18 of the conductive contact 15 is also prevented from inclining toward the contacting projection provided on the end portion 17*a* of the movable beam 17.

When the part of the flexible printed circuit board 13 is put in the housing 11 and the actuator 20 is postured to take second station, each of the cams 21 keeps engaging with the engaging portion provided on the end portion 17*b* of the movable beam 17 of each of the conductive contacts 15 to exert the pressure upon the same. Thereby, the contacting projection provided on the end portion 17*a* of the movable beam 17 is kept in press-contact with the corresponding one of the connecting terminals 14 arranged on the part of the flexible printed circuit board 13 so that the part of the flexible printed circuit board 13 is securely held between the end portion 17*a* of the movable beam 17 and the end portion 16*a* of the fixed beam 16 of the conductive contact 15 and each of the conductive contacts 15 is kept in press-contact with the corresponding one of the connecting terminals 14 arranged on the part of the flexible printed circuit board 13 having been inserted into the housing 11.

Under the situation in which the part of the flexible printed circuit board 13, on which the connecting terminals are arranged, is put in the housing 11, the actuator 20 postured to take the second station, as shown in FIG. 4, is rotated to sift from the second station to the first station, as occasion demands. The rotating movement of the actuator 20 for shifting from the second station toward the first station is opposite in direction to that for shifting from the first station toward the second station.

The actuator 20 in the rotating movement for shifting from the second station toward the first station operates to cause each of the conductive contacts 15 to get out of press-contact with the corresponding one of the connecting terminals 14 arranged on the part of the flexible printed circuit board 13. In this operation, with the rotating movement of the actuator 20 from the second station toward the first station, each of the cams 21 which is put in engagement with each of the conductive contacts 15 for causing the same to come into press-contact with the corresponding one of the connecting terminals 14 arranged on the part of the flexible printed circuit board 13, disengages from the conductive contact 15 so that the pressure from the cam 21 is removed from the engaging portion provided on the end portion 17*b* of the movable beam 17 of each of the conductive contacts 15. Thereby, the movable beam 17 of each of the conductive contacts 15 is caused again with the fulcrum at the end portion 18*c* of the connecting strut 18 of the conductive contact 15 so as to cause the contacting projection provided on the end portion 17*a* to get out of press-contact with the corresponding one of the connecting terminals 14 arranged on the part of the flexible printed circuit board 13. Then, the part of the flexible printed circuit board 13 is able to be drawn out from the housing through the opening 12 provided thereon.

What is claimed is:

1. An electrical connector comprising:

a housing made of insulator and provided with an opening through which a circuit board is inserted into the housing, a plurality of conductive contacts provided to be arranged in the housing to be positioned to correspond respectively to connecting terminals provided on the circuit board when the circuit board is inserted into the housing through the opening provided thereon, and an actuator provided to be rotatable to the housing for taking up a first station and a second station selectively and for engaging with the conductive contacts to cause each of the conductive contacts to come into press-contact with one of the connecting terminals corresponding thereto when the circuit board is inserted into the housing through the opening provided thereon and the actuator is shifted from the first station to the second station and to cause each of the conductive contacts to get out of press-contact with the corresponding one of the connecting terminals when the circuit board has been inserted into the housing and the actuator is shifted from the second station to the first station, wherein each of the conductive contacts has a fixed beam fixed to the housing, a movable beam provided thereon with a contacting projection for coming into contact with the corresponding one of the connecting terminals and an engaging portion for engaging with the actuator and a connecting strut for connecting a portion of the movable beam between the contacting projection and the engaging portion with the fixed beam to support the movable beam, wherein a first side edge portion of the connecting strut on the side of the contacting projection of the movable beam is perpendicular to the fixed beam and a second side edge portion of the connecting strut on the side of the engaging portion of the movable beam slants from the movable beam to the fixed beam so that a first end portion of the connecting strut connected with the fixed beam is wider in a direction along which the fixed beam elongates than a second end portion of the connecting strut connected with the movable beam, and wherein the movable beam swings with a fulcrum at the second end portion of the connecting strut connected with the movable beam when the engaging portion receives the pressure from the actuator whereby the connecting strut is prevented from inclining toward the contacting projection of the movable beam.

2. An electrical connector according to claim 1, wherein each of the conductive contacts is formed entirely into an H-shaped plate member.

3. An electrical connector according to claim 1, wherein the actuator is provided with a plurality of cams each put between the fixed and movable beams of each of the conductive contacts and operative to cause each of the cams to put pressure upon the engaging portion of the movable beam of each of the conductive contacts so as to move the movable beam to swing with the fulcrum at the second end portion of the connecting strut of each of the conductive contacts.

4. An electrical connector according to claim 3, wherein the movable beams of each of the conductive contacts is moved by the cam to swing for causing the engaging portion to go away from the fixed beam and causing the contacting projection to move toward the fixed beam.

* * * * *